US006782226B2

(12) United States Patent
Machida et al.

(10) Patent No.: US 6,782,226 B2
(45) Date of Patent: Aug. 24, 2004

(54) DEVELOPING DEVICE

(75) Inventors: Junji Machida, Toyonaka (JP); Hidetoshi Miyamoto, Takatsuki (JP); Tetsumaru Fujita, Nishinomiya (JP); Masahiko Matsuura, Suita (JP); Yoshiko Yaoi, Itami (JP); Makoto Shimazoe, Toyokawa (JP); Shuichi Nakagawa, Suita (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/367,843

(22) Filed: Feb. 19, 2003

(65) Prior Publication Data

US 2003/0175055 A1 Sep. 18, 2003

(30) Foreign Application Priority Data

Feb. 19, 2002 (JP) ..... 2002-041876
Mar. 28, 2002 (JP) ..... 2002-090124

(51) Int. Cl.[7] ..... G03G 15/08
(52) U.S. Cl. ..... 399/285; 399/286
(58) Field of Search ..... 399/258, 265, 399/279, 285, 286; 492/53, 56

(56) References Cited

U.S. PATENT DOCUMENTS 5,621,506 A * 4/1997 Hosaka et al. ..... 399/284
6,173,138 B1 * 1/2001 Koyama ..... 399/103

FOREIGN PATENT DOCUMENTS

JP 06-264919 9/1994
JP 10-240018 9/1998

* cited by examiner

*Primary Examiner*—Hoan Tran
(74) *Attorney, Agent, or Firm*—Burns, Doane, Swecker & Mathis, L.L.P.

(57) ABSTRACT

A developing device includes a toner bearing member holding a toner on its surface for conveyance of the toner to a development region where the toner bearing member opposes an image bearing member via a predetermined gap therebetween; a regulating member pressed against the surface of the toner bearing member for regulation of the amount of toner conveyed to the development region; and a developing bias source for applying an alternating electric field between the toner bearing member and the image bearing member. The developing device features the use of the toner bearing member including a conductive substrate formed with an elastic layer, an intermediate layer and a surface layer on the surface thereof, respective volume resistances $\rho 1$, $\rho 2$ and $\rho 3$ of which layers satisfy a condition $\rho 2 \leqq \rho 1 \leqq \rho 3$, the toner bearing member having an arithmetic average surface roughness in the range of 0.8 to 2.5 $\mu$m, and the use of the toner having a volume-average particle size of 3 to 8 $\mu$m.

6 Claims, 7 Drawing Sheets

PRIOR ART

DEVELOPING DEVICE

RELATED APPLICATION

The present invention is based on Japanese Patent Application Nos. 2002-41876 and 2002-90124, each content of which is incorporated by reference.

BACKGROUND OF THE INVENTION

1. Field of the Invention

The present invention relates to a developing device for use in an image forming apparatus, such as copping machines, printers and the like, the developing device serving to develop an electrostatic latent image formed on an image bearing member.

2. Description of the Related Art

Heretofore, various developing devices have been used in the image forming apparatuses, such as copying machines, printers and the like, for developing the electrostatic latent image formed on the image bearing member.

There have been known developing devices of a two-component development system using a developer containing a carrier and a toner, and those of a mono-component development system using a developer containing the toner alone or free from the carrier.

The developing devices of the mono-component development system include those of a contact development system wherein a toner bearing member is disposed in contact with the image bearing member, and those of a non-contact development system wherein the toner bearing member opposes the image bearing member via a predetermined gap therebetween in a development region.

The developing device of the contact development system features an excellent reproduction of the electrostatic latent image formed on the image bearing member because the electrostatic latent image is developed by way of physical contact between the toner and the image bearing member. Unfortunately, the toner particles also adhere to a non-imaged area not containing the electrostatic latent image and hence, the resultant image suffers fogging.

Therefore, it is a general practice to suppress the toner adhesion to the non-imaged area by, for example, differentiating moving velocities of the image bearing member and the toner bearing member.

This approach, however, involves a problem that a surface of the image bearing member is worn due to the contact with the toner bearing member and hence, the developing device cannot accomplish stable image formation.

On the other hand, an example of the developing device of the non-contact development system is shown in FIG. 1.

In this developing device, a toner 't' in a main body of a developing device 1 is moved toward a toner bearing member 3 by means of a feed member 2 so as to be held on a surface of the toner bearing member 3, which is rotated to convey the toner 't'.

A regulating member 4 is pressed against the surface of the toner bearing member 3 conveying the toner 't' to a development region where the toner bearing member 3 opposes an image bearing member 10 via a predetermined gap 'd' therebetween. The regulating member 4 thus abutted regulates the amount of toner 't' held on the surface of the toner bearing member 3 while triboelectrifying the toner 't'.

Subsequently, the toner bearing member introduces the regulated and triboelectrified toner 't' into the development region where the toner bearing member opposes the image bearing member 10 via the predetermined gap 'd'. A developing bias source 5 applies an alternating voltage for applying an alternating electric field between the toner bearing member 3 and the image bearing member 10. The electrostatic latent image defining an imaged area of the image bearing member 10 is developed with the toner 't' supplied from the toner bearing member 3.

In this case where the regulating member 4 is pressed against the surface of the toner bearing member 3 to regulate the amount of toner 't' to be conveyed to the development region, the toner 't' is subjected to such a great load due to a contact pressure from the regulating member 4 that the toner 't' layer on the surface of the toner bearing member 3 is cracked to produce fine particles. The fine particles are gradually accumulated to be fused to the surface of the toner bearing member 3, entailing a problem that the resultant image suffers density variations.

Therefore, the conventional developing device employs the toner bearing member 3 which includes a conductive substrate 3*a* formed of a metal roller, and an elastic layer 3*b* formed over the conductive substrate and including an elastic material, such as rubber, containing a conductive material, such as carbon black. Such a toner bearing member reduces the load on the toner 't' due to the contact pressure from the regulating member 4, thereby preventing the toner 't' layer from being cracked.

Unfortunately, the toner bearing member 3 formed with the elastic layer 3*b* on its surface has the following problem. Since the conductive material such as carbon black, is not properly dispersed in the elastic material so that the elastic layer 3*b* suffers varied resistances. The varied resistances of the elastic layer lead to variations in the alternating electric field applied between the toner bearing member 3 and the image bearing member 10 and hence, the resultant image suffers density variations.

More recently, absolution to this problem has been proposed wherein a resistance control layer of high resistance is overlaid on the elastic layer, as disclosed in JP-T-2964821 (JP-A-6-264919).

However, with the use of the toner bearing member having the resistance control layer of high resistance overlaid on the elastic layer, the variations of the alternating electric field applied between the toner bearing member and the image bearing member cannot be reduced adequately. Particularly, in a case where a toner of fine particles is employed to form a fine image of high quality, resultant image still suffers the density variations.

In the conventional developing devices, it is a common practice to interpose a spacer (not shown) between the toner bearing member 3 and the image bearing member 10 such that the toner bearing member 3 and the image bearing member 10 may oppose each other via a predetermined gap therebetween. The spacer ensures a constant gap between the toner bearing member 3 and the image bearing member 10 in opposing relation.

In this approach however, the gap between the toner bearing member 3 and the image bearing member 10 opposing each other in the development region may be varied because of the variations of forming precisions or fixing precisions of these members 10, 3 or because of the wear or deformation of the spacer. This leads to varied magnitudes of the electric field applied between the toner bearing member and the image bearing member and hence, the resultant image suffers the density variations.

According to the conventional developing devices, therefore, a developing bias voltage applied between the toner bearing member 3 and the image bearing member 10 is increased in the peak-to-peak value of an AC voltage so as to cause a sufficient amount of toner 't' to jump from the toner bearing member 3 to the image bearing member 10, thereby suppressing the density variations.

In this case where the developing bias voltage is increased in the peak-to-peak value of the AC voltage, however, a potential difference between a surface potential of the image bearing member 10 and a peak value of the developing bias voltage is increased so that current leakage occurs between the toner bearing member 3 and the image bearing member 10. The current leakage detrimentally produces noises in the resultant image.

According to the state of the art, therefore, the developing bias voltage is properly controlled in the following manner. First, the current leakage is produced by varying the developing bias voltage applied between the toner bearing member 3 and the image bearing member 10, while a density sensor (not shown) senses the amount of toner 't' caused by the leakage to adhere to the image bearing member 10. Then, the developing bias voltage is set to a proper value based on the sensed amount of toner Unfortunately, the above density sensor is expensive so that the developing device is increased in costs. In addition, the density sensor cannot detect current leakage occurred at place other than an area sensed by the sensor. Accordingly, it is impossible to set the developing bias voltage to such a proper value at all times as to prevent the occurrence of leakage.

SUMMARY OF THE INVENTION

It is an object of the invention to provide a solution to the above problems encountered by the developing device including the toner bearing member holding the toner on its surface for conveyance of the toner to the development region where the toner bearing member opposes the image bearing member via the predetermined gap therebetween; the regulating member pressed against the surface of the toner bearing member for regulation of the amount of toner conveyed to the development region; and the developing bias source for applying the alternating electric field between the toner bearing member and the image bearing member.

Specifically, a first object of the invention is to prevent the regulating member pressed against the toner bearing member for regulation of the amount of toner from cracking the toner layer on the toner bearing member to produce fine toner particles.

A second object of the invention is to provide for a simple and proper control of the developing bias voltage in order to obviate the occurrence of leakage between the toner bearing member and the image bearing member despite the errors of the gap or the like between the toner bearing member and the image bearing member.

A developing device according to a first aspect of the invention comprises a toner bearing member holding a toner on its surface for conveyance of the toner to a development region where the toner bearing member opposes an image bearing member via a predetermined gap therebetween; a regulating member pressed against the surface of the toner bearing member for regulation of the amount of toner conveyed to the development region; and a developing bias source for applying an alternating electric field between the toner bearing member and the image bearing member, and is characterized in that the toner bearing member includes a conductive substrate formed with an elastic layer, an intermediate layer and a surface layer on the surface thereof respective volume resistances $\rho\mathbf{1}$, $\rho\mathbf{2}$ and $\rho\mathbf{3}$ of which layers satisfy a condition $\rho\mathbf{2} \leqq \rho\mathbf{1} \leqq \rho\mathbf{3}$, the toner bearing member having an arithmetic average surface roughness in the range of 0.8 to 2.5 $\mu$m, and that the toner has a volume-average particle size in the range of 3 to 8 $\mu$m.

A developing device according a second aspect of the invention comprises a toner bearing member holding a toner on its surface for conveyance of the toner to a development region where the toner bearing member opposes an image bearing member via a predetermined gap therebetween; a regulating member pressed against the surface of the toner bearing member for regulation of the amount of toner conveyed to the development region; a developing bias source for applying an alternating electric field between the toner bearing member and the image bearing member; a leakage generator varying a leakage detection voltage applied between the image bearing member and the toner bearing member for production of leakage between the image bearing member and the toner bearing member; and a leakage detector unit for detecting the leakage based on current flowing between the image bearing member and the toner bearing member.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Developing devices according to preferred embodiments of the invention will hereinbelow be described in detail with reference to the accompanying drawings.

First Embodiment

Figure 1:
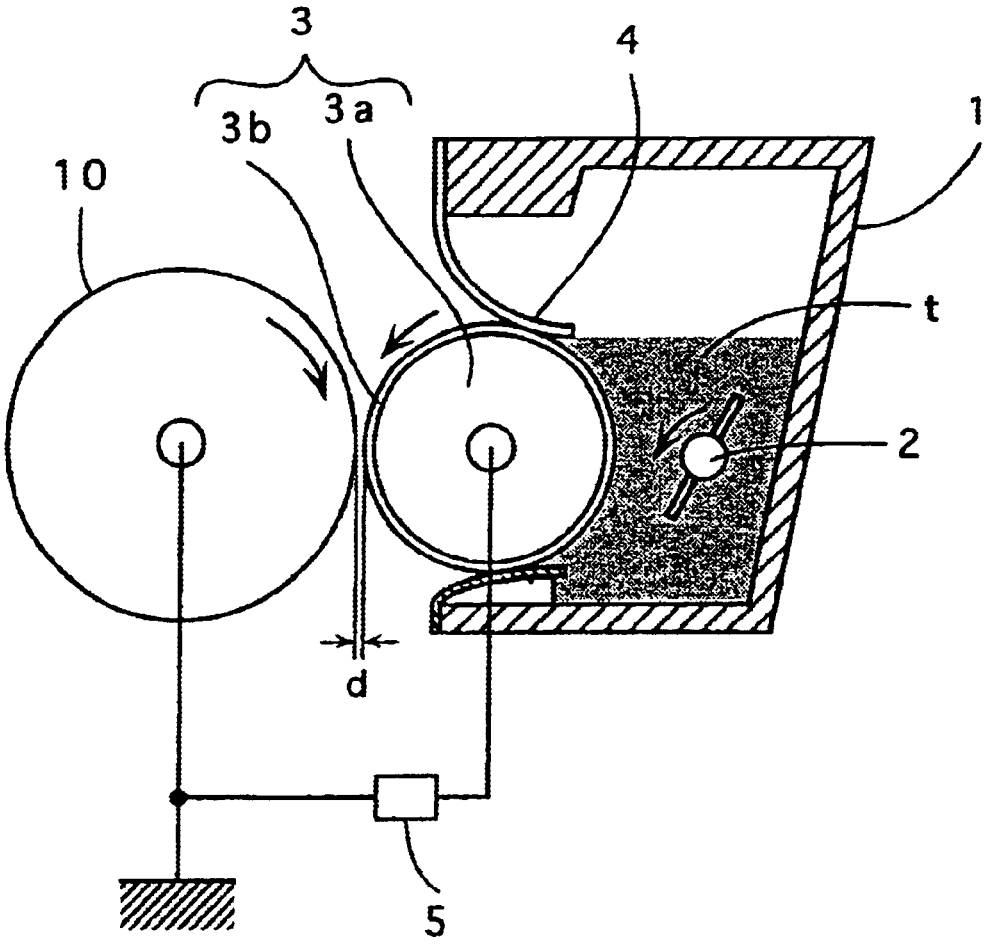
FIG. 1 is a schematic diagram showing a conventional developing device.
Figure 2:
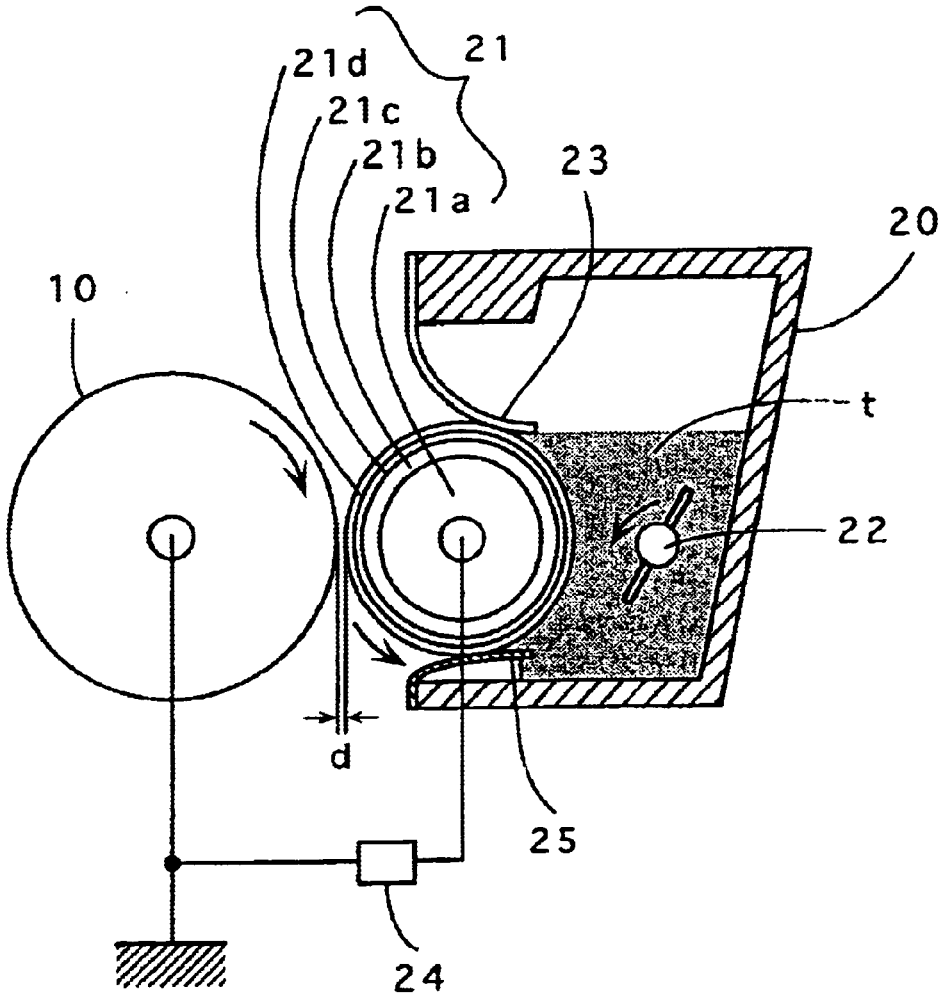
FIG. 2 is a schematic diagram showing a developing device according to a first embodiment of the invention.

As shown in FIG. 2, a developing device according to a first embodiment of the invention has an arrangement wherein a toner bearing member 21 is disposed in a main body 20 as opposing an image bearing member 10 via a predetermined gap 'd' therebetween.

While the toner bearing member 21 is rotated, a toner 't' stored in the main body 10 is moved toward the toner bearing member 21 by a feed member 22 so as to be fed onto the toner bearing member 21 which, in turn, holds the toner 't' on its surface for conveyance.

A regulating member 23 is pressed against the surface of the toner bearing member 21 thus conveying the toner 't', thereby regulating the amount of toner 't' held on the surface of the toner bearing member 21 while triboelectrifying the toner 't'.

Subsequently, the toner bearing member 21 delivers the regulated and triboelectrified toner 't' to a development region where the toner bearing member 21 opposes the image bearing member 10 via the predetermined gap 'd'. A developing bias source 24 applies an alternating voltage to apply an alternating electric field between the toner bearing member 21 and the image bearing member 10 such that the toner 't' held on the surface of the toner bearing member 21 is caused to jump to the image bearing member 10. Thus, the toner 't' is supplied to an imaged area defined by an electrostatic latent image formed on the image bearing member 10, developing the latent image.

After the electrostatic latent image is developed in this manner, the toner bearing member 21 conveys the toner 't' remaining on its surface into the main body 20, while bringing the toner 't' into contact with a static eliminator 25 disposed at the main body 20 for de-electrification of the toner. The de-electrified toner 't' is liberated from the surface of the toner bearing member 21 so as to be returned into the main body 20.

The developing device according to the first embodiment employs the toner bearing member 21 which comprises a conductive substrate 21*a* formed of a metal roller, and an elastic layer 21*b*, an intermediate layer 21*c* and a surface layer 21*d* laminated on a surface of the conductive substrate 21*a*. A volume resistance ρ1 of the elastic layer 21*b*, that ρ2 of the intermediate layer 21*c* and that ρ3 of the surface layer 21*d* satisfy a condition $\rho 2 \leqq \rho 1 \leqq \rho 3$. In addition, the toner bearing member 21 has an arithmetic average surface roughness Ra in the range of 0.8 to 2.5 μm.

In a case where the employed toner bearing member 21 satisfy $\rho 2 \leqq \rho 1 \leqq \rho 3$ where ρ1, ρ2 and ρ3 denote the volume resistances of the elastic layer 21*b*, intermediate layer 21*c* and surface layer 21*d*, respectively, the intermediate layer 21*c* having the smaller volume resistance ρ2 alleviates the variations of the volume resistance ρ1 of the elastic layer 21*b* while the surface layer 21*d* having the greater volume resistance ρ3 contributes to a suitable volume resistance of the toner bearing member 21 as a whole. This is effective to suppress the variations of the alternating electric field applied between the toner bearing member 21 and the image bearing member 10. Accordingly, favorable images less susceptible to density variations may be formed even when a toner 't' of fine particles having a volume-average particle size of 3 to 8 μm is used.

In the case of the toner bearing member 21 having the arithmetic average surface roughness Ra of 0.8 to 2.5 μm which is used in combination with the toner 't' of fine particles having the volume-average particle size of 3 to 8 μm the toner bearing member 21 is less prone to cause fogging on the resultant image by delivering an excessive amount of toner 't' to the development region, or to cause density variations of the resultant image by delivering an insufficient amount of toner 't' to the development region. Hence, favorable images may be obtained.

The elastic layer 21*b* may comprise, for example, an elastic material such as silicone rubber, isoprene rubber, butadiene rubber, butyl rubber, chloroprene rubber, nitrile rubber, styrene-butadiene rubber, acrylic rubber, ethylene-propylene rubber, ethylsne-propylene-diene rubber, urethane rubber, fluorine rubber, thermoplastic rubber and the like; and a conductive material admixed thereto, the conductive material including Ketchen black, acetylene black, furnace black, titanium black, fine particles of a metal oxide or the like. In a case where an excessive amount of conductive material is admixed to the elastic material so that the elastic layer 21*b* is too small in the volume resistance ρ1, the elastic layer 21*b* suffers low moldability. In a case where, on, the other hand, an insufficient amount of conductive material is used, the elastic layer suffers increased variations in the volume resistance ρ1. Therefore, it is preferred to control the volume resistance ρ1 of the elastic layer 21*b* in the range of $1\times10^4$ to $1\times10^6$ Ω·m. Furthermore, the elastic layer 21*b* may have a hardness of JIS-A 5 to 60° or preferably of JIS-A 10 to 50°, and a thickness of 0.3 to 1.5 mm or preferably of 0.5 to 10 mm.

The intermediate layer 21*c* may comprise, for example, an elastic material such as silicone rubber, isoprene rubber, butadiene rubber, butyl rubber, chloroprene rubber, nitrile rubber, styrene-butadiene rubber, acrylic rubber, ethylene-propylene rubber, urethane rubber, epichlorohydrin rubber, silicone resin, acrylic resin, polyester resin, ABS resin, styrene resin, urethane resin and the like, and any of the same conductive materials as those used in the elastic layer 21*b*. It is preferred to control the volume resistance ρ2 of the intermediate layer 21*c* to $1\times10^4$ Ω·m or less. Furthermore, the intermediate layer 21*c* may have a thickness of 5 to 30 μm or preferably of 10 to 25 μm.

The surface layer 21*d* may comprise, for example, an elastic material such as silicone rubber, butadiene rubber, chloroprene rubber, nitrile rubber, acrylic rubber, urethane rubber, silicone resin, acrylic resin, urethane resin, fluorine resin, nylon resin and the like; and any of the same conductive material as those used in the elastic layer 21*b*. In a case where the surface layer 21*d* is too small in the volume resistance ρ3, leakage is more likely to occur, as described above, when the alternating electric field is applied between the toner bearing member 21 and the image bearing member 10 for development. Where, on the other hand, the surface layer 21*d* is too great in the volume resistance ρ3, the magnitude of the alternating electric field applied between the toner bearing member 21 and the image bearing member 10 is so small that the toner 't' is not sufficiently supplied to the imaged area of the image bearing member 10. Therefore, it is preferred to control the volume resistance ρ3 of the surface layer 21*d* in the range of $1\times10^{6}$ to $1\times10^{12}$ Ω·m. Furthermore, the surface layer 21*d* may have a thickness of 5 to 40 μm or preferably of 10 to 30 μm.

The developing device of the first embodiment may use the toner 't' which has a volume-average particle size in the range of 3 to 8 μm and generally comprises a binder resin incorporating a colorant and also a electrification controlling agent, an anti-offset agent, a fluidizing agent and the like.

The above toner 't' may be prepared by any of the known methods commonly used in the art, which include, for example, milling, emulsion-polymerization, suspension-polymerization and the like.

Any of the known binder resins commonly used in the art may be used as the above binder resin of the toner 't'. Examples of a usable binder resin include polyester resins, styrene resins, styrene-acrylic copolymers, epoxy resins, synthetic terpene resins, synthetic rosin ester resins and the like. These resins may be used alone or in combination of two or more types.

Where the binder resin has a glass transition point Tg of not higher than 50° C., the toner 't' is decreased in storage stability. In a case where, on the other hand, the binder resin has a glass transition point Tg of not lower than 70° C., the toner 't' is decreased in adhesion to a receiving sheet or the like. Therefore, the toner 't' may employ a binder resin having a glass transition point of 50 to 70° C., or preferably of 55 to 68° C. Where the binder resin has a softening point of not higher than 80° C., the toner 't' is decreased in storage stability. In a case where, on the other hand, the binder resin has a softening point of not lower than 160° C., the toner 't' is decreased in adhesion to the receiving sheet or the like. Therefore, the toner 't' may employ a binder resin having a softening point of 80 to 160° C., or preferably of 85 to 150° C.

The above colorant may be any of the known colorants commonly used in the art. Examples of a usable black colorant include carbon black, iron black, iron oxide, aniline black and the like. Examples of a usable yellow colorant include Benzidlne Yellow G. Naphthol Yellow S, Permanent Yellow NCG, Hansa Yellow G and the like. Examples of a usable red colorant include Permanent Orange GTR, Hydrazone Orange, Vulcan Orange, Benzidine Orange. Permanent Red 4R, Lake Red D and the like. Examples of a usable blue colorant include Phthalocyanlne Blue, Victoria Blue Lake, Persian blue and the like.

Examples of a usable electrification controlling agent include chromium-complex-type azo dyes, zinc complexes, aluminum complexes, Kalex allene compounds and the like. The electrification controlling agent may be used in an amount of 0.5 to 8 parts by weight or preferably of 1 to 5 parts by weight based on 100 parts by weight of the above binder resin.

Examples of a usable anti-offset agent include low-molecular weight polyolefin wax, low-molecular weight oxidized polyolefin wax, carnauba wax, Saxol wax. Candelilla wax, jojoba oil wax, ester wax and the like. The anti-offset agent may be used in an amount of 0.1 to 8 parts by weight or preferably of 2 to 6 parts by weight based on 100 parts by weight of the binder resin.

Examples of a usable fluidizing agent include inorganic fine particles such as of silica, titanium dioxide, alumina, strontium titanate, and the like. The inorganic fine particles may be hydrophobic-treated with a silane coupling agent, titanium coupling agent, silicone oil or the like.

In the developing device of the first embodiment, the developing bias source 24 applies the alternating voltage to apply the alternating electric field between the toner bearing member 21 and the image bearing member 10 thereby allowing the toner 't' held on the surface of the toner bearing member 21 to be supplied to the imaged area of the image bearing member 10 for development. If, at this time, a back-transfer electric field biasing the toner from the image bearing member back to the toner bearing member is too strong, leakage occurs between the imaged area of the image bearing member and the toner bearing member. If, on the contrary, the back-transfer electric field is too weak or an effective time of the back-transfer electric field is too short, proper toner jumping is not effected between the toner bearing member and the image bearing member. Particularly, the toner of fine particles entails varied toner jumping, tending to cause streaking. Therefore, it is preferred to control the magnitude of the back-transfer electric field in the range of $2.5\times10^{-6}$ to $14\times10^{-6}$ V/m and to control the per-period effective time of the back-transfer electric field to at least $3.0\times10^{-6}$ sec.

Experiment

This experiment used 9 different types of toner bearing members A1 to A9 wherein the elastic layer 21*b*, intermediate layer 21*c* and surface layer 21*d* of the aforesaid toner bearing member 21 are varied in the type or the arithmetic surface roughness Ra, and also used 3 different types of toners T1 to T3. Development processes were carried out with different alternating electric fields applied between the toner bearing member 21 and the image bearing member 10 and resultant images were evaluated.

Toner Bearing Member A1

A toner bearing member A1 employed an aluminum roller having an outside diameter of 14 mm as the conductive substrate.

The following procedure was taken to form an elastic layer on an outer periphery of the conductive substrate. A mixture containing respective 50 parts by weight of A fluid and B fluid of liquid silicone rubber (KE-1935 commercially available from Shin-Etsu Chemical Co., Ltd.), and 8 parts by weight of conductive carbon black (#3030 commercially available from Mitsubishi Kagaku Corporation) was loaded in a mixer/deaerator system (Hybrid Mixer HM commercially available from KEYENCE CORPORATION), which was operated for 3 minutes to mixingly deaerate the mixture. Thus was obtained a coating solution for elastic layer.

Subsequently, the conductive substrate was set in a mold while the resultant coating solution for elastic layer was fed on the outer periphery of the conductive substrate. The coating solution for elastic layer was cured by heating at 120° C. for 5 minutes. After removal of the mold, the resultant layer was further subjected to 1-hour heating at 150° C. to form the elastic layer on the outer periphery of the conductive substrate. The resultant elastic layer was polished by means of a traverse-type cylindrical polishing machine to obtain a 1 mm-thick elastic layer on the outer periphery of the conductive substrate.

Subsequently, a solution including 5 parts by weight of styrene-butadiene elastomer (AR-S-3948A commercially available from ARON KASEI) dissolved in 100 parts by weight of toluene, as a solvent was admixed with 0.2 parts by weight of conductive carbon black (Ketchen black commercially available from LION ACZO Co., Ltd.) and 0.3 parts by weight of conductive carbon black (Printe XE2 commercially available from Degussa Corp). The resultant solution mixture was uniformly dispersed by means of the mixer/deaerator system (Hybrid Mixer HM commercially available from KEYENCE CORPORATION) thereby to obtain a coating solution for intermediate layer.

The elastic layer formed on the outer periphery of the conductive substrate was surface treated with a silane coupling agent and then spray coated with the resultant coating solution for intermediate layer. The coating solution was dried to form an intermediate layer having a thickness of 10 μm over the elastic layer.

Subsequently, 100 parts by weight of polyurethane emulsion of 35 wt % solids content (YODOSOL RX-7 commercially available from Japan NSC, Ltd.), 035 parts by weight of conductive carbon black (Valcan XC-7 commercially available from Cabot Inc.) and 3.5 parts by weight of roughness imparting particles (SILICASYLOPHARE 470 commercially available from Fuji Sllysia Chemical, Ltd.) were loaded in the mixer/deaerator system (Hybrid Mixer HM commercially available from KEYENCE CORPORATION) and mixingly deaerated for 3 minutes. Thus was obtained a coating solution for surface layer.

The resultant coating solution for surface layer was spray coated over the intermediate layer and dried to form a surface layer having a thickness of 18 μm on the intermediate layer. Thus was fabricated the toner bearing member A1.

Toner Bearing Member A2

A toner bearing member A2 was fabricated the same way as the toner bearing member A1, except that the roughness imparting particles used in the surface layer of the toner bearing member A1 were changed. That is, 3.5 parts by weight of roughness imparting particles (SILICASYLOPHARE 380 commercially available from Fuji Silysia Chemical, Ltd.) were used.

Toner Bearing Member A3

A toner bearing member A3 was also fabricated the same way as the toner bearing member A1, except that the roughness imparting particles used in the surface layer of the toner bearing member A1 were changed. That is, 5.0 parts by weight of roughness imparting particles (Methylsilicone MSP-150 commercially available from Nikko Fine Products Co., Ltd.) were used.

Toner Bearing Member A4

A toner bearing member A4 was also fabricated the same way as the toner bearing member A1, except that the roughness imparting particles used in the surface layer of the toner bearing member A1 were changed. That is, 4.0 parts by weight of roughness imparting particles (SILICASYLOPHARE #440 commercially available from Fuji Silysia Chemical Ltd.) were used.

Toner Bearing Member A5

A toner bearing member A5 was also fabricated the same way as the toner bearing member A1, except that the roughness imparting particles used in the surface layer of the toner bearing member A1 were changed. That is, 6 parts by weight of roughness imparting particles (Acrylic Fine Particles commercially available from SEKISUI PLASTICS CO., LTD.) were used.

Toner Bearing Member A6

A toner bearing member A6 was also fabricated the same way as the toner bearing member A1, except that the conductive carbon black used in the elastic layer of the toner bearing member A1 was changed. That is, 5 parts by weight of conductive carbon black (Black Pearls 3500 commercially available from Cabot Inc.) was used.

Toner Bearing Member A7

A toner bearing member A7 was also fabricated the same way as the toner bearing member A1, except that the conductive carbon blacks used in the intermediate layer of the toner bearing member A1 were changed. That is, the two types of conductive carbon blacks were replaced by 0.3 parts by weight of conductive carbon black (Valcan XC-7 commercially available from Cabot Inc.).

Toner Bearing Member A8

A toner bearing member A8 was also fabricated the same way as the toner bearing member A1, except that the conductive carbon blacks used in the elastic layer and in the intermediate layer of the toner bearing member A1 were changed. That is, 5 parts by weight of conductive carbon black (Ketchen black commercially available from LION ACZO Co., Ltd.) and 7 parts by weight of conductive carbon black (#3030 commercially available from Mitsubishi Kagaku Corporation) were added to form an elastic layer, whereas 0.3 parts by weight of conductive carbon black (Valcan XC-7 commercially available from Cabot Inc.) was added to form an intermediate layer just as in the toner bearing member A7.

Toner Bearing Member A9

A toner bearing member A9 was also fabricated the same way as the toner bearing member A1, except that the carbon blacks used in the elastic layer and in the surface layer of the toner bearing member A1 were changed. That is, 5 parts by weight of conductive carbon black (Black Pearls 3500 commercially available from Cabot Inc.) was added to form an elastic layer just as in the toner bearing member A6, whereas 0.4 parts by weight of conductive carbon black (Ketchen black commercially available from LION ACZO Co., Ltd.) was added to form a surface layer.

Each of the resultant toner bearing members A1 to A9 was determined for the volume resistance ρ1 (Ω·m) of the elastic layer thereof, that ρ2 (Ω·m) of the intermediate layer thereof and that ρ3 (Ω·m) of the surface layer thereof, when applied with a voltage of 100 V. Furthermore, the toner bearing members A1 to A9 were each determined for the arithmetic average surface roughness Ra (μm) thereof. The results are listed in Table 1 as below.

The volume resistance ρ1 (Ω·m) of the respective elastic layer and that ρ3 (Ω·m) of the respective surface layer of the toner bearing members A1 to A9 were determined as follows. The elastic layer or surface layer of each toner bearing member was formed on the aluminum roller surface and subjected to measurement under a voltage of 100 V, as pressed against a roller-shaped metal electrode. On the other hand, the volume resistance ρ2 (Ω·m) of the respective intermediate layer of the toner bearing members A1 to A9 was measured under a voltage of 10 V because the application of 100 V may produce leakage.

The arithmetic average surface roughnesses Ra (Gy) of the toner bearing members A1 to A9 were determined by means of a surface texture measuring instrument (SURFCOM 1400A commercially available from TOKYO SEIMITSU CO., LTD.) under conditions of scanning rate at 0.3 mm/sec, cutoff of 0.8 mm, measuring range of 4 mm, and measuring force of 0.7 mm/N.

TABLE 1

| TYPE OF TONER BEARING MEMBER | ρ1 (Ω · m) | ρ2 (Ω · m) | ρ3 (Ω · m) | Ra (μm) |
|---|---|---|---|---|
| A1 | $4.8 \times 10^4$ | $1.2 \times 10^3$ | $2.7 \times 10^8$ | 1.7 |
| A2 | $4.8 \times 10^4$ | $1.2 \times 10^3$ | $2.7 \times 10^8$ | 1.0 |
| A3 | $4.8 \times 10^4$ | $1.2 \times 10^3$ | $2.7 \times 10^8$ | 2.1 |
| A4 | $4.8 \times 10^4$ | $1.2 \times 10^3$ | $2.7 \times 10^8$ | 0.7 |
| A5 | $4.8 \times 10^4$ | $1.2 \times 10^3$ | $2.7 \times 10^8$ | 2.6 |

TABLE 1-continued

| TYPE OF TONER BEARING MEMBER | ρ1 (Ω · m) | ρ2 (Ω · m) | ρ3 (Ω · m) | Ra (μm) |
|---|---|---|---|---|
| A6 | $6.7 \times 10^6$ | $1.2 \times 10^3$ | $2.7 \times 10^8$ | 1.7 |
| A7 | $4.8 \times 10^4$ | $6.8 \times 10^5$ | $2.7 \times 10^8$ | 1.7 |
| A8 | $6.5 \times 10^3$ | $6.8 \times 10^5$ | $2.7 \times 10^8$ | 1.7 |
| A9 | $6.7 \times 10^6$ | $1.2 \times 10^3$ | $3.4 \times 10^4$ | 1.7 |

The results show that the toner bearing members A1 to A3 satisfy all of the conditions set forth in claims 1 and 2, whereas the toner bearing member A6 satisfies only the conditions set forth in claim 1. In contrast, the toner bearing member A4 has an insufficient arithmetic average surface roughness Ra of 0.7 μm whereas the toner bearing member AS has an excessive arithmetic average surface roughness Ra of 2.6 μm. That is the toner bearing members A4 and A5 do not satisfy the condition 0.8 μm≦Ra≦2.5 μm. The toner bearing members A7 to A9 do not satisfy the condition ρ2≦ρ1≦ρ3.

Toner T1

A toner T1 was prepared as follows. A 5-liter, 4-necked flask equipped with a reflux condenser, nitrogen gas inlet, thermoregulator, thermometer and mechanical stirrer was installed in a mantle heater. Then, 1200 g of bisphenol propylene oxide adduct, 145 g of bisphenol ethylene oxide adduct, 360 g of isophthalic acid and 95 g of terephthalic acid were charged to the 4-necked flask wherein dehydro-polycondensation was carried out at 240° C. while introducing nitrogen gas. Thus was obtained a low-molecular weight polyester resin having a glass transition point of 63.4° C.

On the other hand, a 5-liter, 4-necked flask having the same settings as the above was installed in the mantle heater. Then, 1800 g of bisphenol propylene oxide adduct, 790 g of isophthalic acid, 110 g of succinic acid, 128 g of diethylene glycol, and 83 g of glycerin were charged to the 4-necked flask wherein dehydro-polycondensation was carried out at 240° C. while introducing nitrogen gas. Thus was obtained a high-molecular weight polyester resin having a glass transition point of 40° C.

Subsequently, 3800 g of the above low-molecular weight polyester resin and 1200 g of the above high-molecular weight polyester resin were stirred by a Henschel mixer until homogeneous the resultant mixture and 100 g of diphenylmethane-4,4-dilsocyanate were charged to a heating kneader to be reacted at 120° C. for 1 hour. After confirming the substantial absence of liberated igocyanate group, the reaction product was cooled to give a polyester resin having urethane bond. The resultant polyester resin had a glass transition point Tg of 64.3° C. a softening point of 128° C. and an acid value of 20 KOHmg/g.

Next, 100 parts by weight of the resultant polyester resin, 8 parts by weight of carbon black as a colorant (Raven1255 commercially available from Columbia Carbon Inc.). 2.5 parts by weight of electrification controlling agent (VONTRON S-34 commercially available from Orient Industry Co., Ltd.), 2 parts by weight of oxidized low-molecular weight polypropylene as an anti-offset agent (Umex ST-500 commercially available from Sanyo Chemical Industries, Ltd.) and 1.0 part by weight of carnauba wax (commercially available from Katoh Yoko Co., Ltd.) were adequately blended together by the Henschel mixer and then kneaded by a twin-screw extruder/kneader. The product was cooled and crushed into coarse particles, which were further pulverized by means of a Crypton pulverizer (available from Kawasaki Heavy Industries Ltd.). The resultant particles were finely pulverized by means of a supersonic jet pulverizer (available from Japan Pneumatic Industries Co., Ltd.). The resultant fine particles were classified by means of a classifier (Elbow-jet commercially available from Matsuzaka Trading Co., Ltd.) to give toner particles having a volume average particle size of 65 μm.

Subsequently, 100 parts by weight of the resultant toner particles and 0.6 parts by weight of hydrophobic silica (CABOSIL TS-500 commercially available from Cabot Specialty Chemical Inc.) were stirred by means of a homogenizer (commercially available from Tokusyu Kika Kogyo, Co., Ltd.) operated at 1500 rpm for 3 minutes Thus was obtained the toner T1 having a volume-average particle size of 6.5 μm.

Toner T2

A toner T2 was prepared as follows. Toner particles having a volume-average particle size of 9.2 μm were prepared the same way as the toner T1, except that the above classifier (Elbow-jet commercially available from Matsuzaka Trading Co., Ltd.) was operated under different classification conditions.

Subsequently, 100 parts by weight of the resultant toner particles and 0.4 parts by weight of hydrophobic silica (CABOSIL TS-500 commercially available from Cabot Specialty Chemical Inc.) were stirred by means of the homogenizer (commercially available from Tokusyu Kika Kogyo, Co., Ltd.) operated at 1500 rpm for 3 minutes. Thus was obtained the toner T2 having a volume-average particle size of 9.2 μm.

Toner T3

A toner T3 was prepared as follows. A mixture of 250 parts by weight of blue pigment (SANYO CYANINE BUUEKRO commercially available from Sanyo Color Works, Ltd.) and 5 parts by weight of colloidal silica (#200 commercially available from Nippon Aerosil Co., Ltd.) was prepared by means of a 1-liter blender (Auster Blender commercially available from Nishiyama Seisakusho Co., Ltd.) operated at 1500 rpm for 3 minutes. Then, a solution including 15 parts by weight of silane coupling agent (Vinyltrimethoxysilane SZ-6300 commercially available from Dow Corning Toray Silicone Co., Ltd.) dissolved in 40 parts by weight of ethanol was added to the mixture in three steps, while the blender was kept operated at 10000 rpm. Then, the resultant solution mixture was further subjected to 5-minute stirring at 115000 rpm, followed by heating at 80° C. for 5 hours. Thus was obtained a surface treated blue pigment.

Next, styrene monomer and n-butyl methacrylate monomer were each washed with 2 wt % aqueous sodium hydrate solution using a separating funnel and then washed with ion-exchange water over 3 times. Subsequently, the resultant styrene monomer and n-butyl methacrylate monomer were each dehydrated with anhydrous calcium chloride.

Then, a 500-cc beaker was charged with 87.5 g of the resultant styrene monomer, 12.5 g of the resultant n-butyl methacrylate monomer, 3.5 g of carnauba wax (#1 commercially available from Katoh Yoko Co., Ltd.) and 0.02 g of lauryl peroxide as a polymerization catalyst, which were stirred for 10 minutes in 100° C. water bath. Then, the resultant mixture was quenched to 20° C. to give a pre-polymer.

Next, a Hybrid Mixer (HM-500 commercially available from KEYENCE CORPORATION) was operated to form a homogeneous dispersion including 100 g of the resultant pre-polymer and 49 of the above blue pigment. A 1-liter beaker was charged with the resultant dispersion and a solution of 2.5-g sodium polyacrylate (polymerization degree: 2,700–7,500) dissolved in 300-cc ion-exchange water, and was further charged with 0.3 g of polymerization catalyst (V-65 commercially available from Wako Pure Chemical Industries, Ltd.) and 2.0 g of dodecyl mercaptan as a chain transfer agent. The beaker was installed in a TK homomixer (Model M commercially available from Tokusyu Kika Kogyo, Co., Ltd.) which was operated at 6500 rpm for 5 minutes. Thus was obtained a suspension.

The resultant suspension was charged to a 4-necked flask equipped with a reflux condenser, nitrogen gas inlet, thermometer and mechanical stirrer and was subjected 7-hour polymerization at 70° C. with stirring at 300 rpm, which was followed by 1 hour polymerization at 90° C. Then, the resultant precipitates were filtered off, washed with pure water over 3 times and dried at 40° C. The product was further dried at 30° C. in a vacuum dryer and then classified by the classifier (Elbow-jet commercially available from Matsuzaka Trading Co., Ltd.). Thus were obtained toner particles having a volume-average particle size of 5.2 μm, a glass transition point of 58° C. and a softening point of 123° C.

Next, 100 parts by weight of the resultant toner particles, 0.5 parts by weight of hydrophobic silica (CABOSIL ST-500 commercially available from Cabot Speciality Chemical inc.) and 1.5 parts by weight of hydrophobic titanium oxide (STT-30S commercially available from Titan Kogyo Kabushiki Kaisha) were stirred in the homogenizer (commercially available from Tokusyu Kika Kogyo, Co., Ltd.) operated at 1500 rpm for 3 minutes. Thus was obtained the toner T3 having a volume-average particle size of 5.2 μm.

Examples 1 to 6 and Comparative Examples 1 to 6 individually used one of the toner bearing members A1 to A9 in combination with one of the toners T1 to T3 as shown in Table 2 below. The respective combination of toner bearing member ant toner was mounted in the developing device shown in FIG. 2 which performed the developing operations. Measurement was taken on the amount of toner (g/m$^2$) conveyed to the development region by each of the toner bearing members A1 to A9 and on the electrostatic charge (μC/g) on the toner on each of the toner bearing members. In addition, the resultant images were evaluated for density variations, half-tone variations, fogging, dot reproducibility, and streaking. The results are listed in Table 3 below. As to each of the evaluation items including density variations, half-tone variations, fogging, dot reproducibility and streaking, a mark ○ stands for "favorable", Δ stands for "practically acceptable" and x stands for "practically unacceptable".

The above development process was carried out under the conditions of a circumferential speed of the image bearing member at 100 mm/s, a circumferential speed of each toner bearing member A1 to A9 at 150 mm/s, a potential of the non-imaged area of the image bearing member at −550 V, and a potential of the imaged area at −100 V.

In the developing device of each of Examples 1 to 4 and Comparative Examples 1 to 6, a gap 'd' of 120 μm was formed between the image bearing member and the toner bearing member while the aforesaid developing bias source applied an alternating voltage to the gap 'd' to effect the development process, the alternating voltage formed by superimposing a DC voltage of −350 V and an AC voltage having a peak-to-peak value Vpp of 1600 V, a frequency of 2000 Hz and a duty ratio of 30%. In this case, a back-transfer electric field acting to bias the toner on the imaged area of the image bearing member back to the toner bearing member had a magnitude of $6\times10^{-6}$ V/m and a per-period effective time of $3.50\times10^{-4}$ sec., as shown in Table 2.

In the developing device of Example 5, a gap 'd' of 250 μm was formed between the image bearing member and the toner bearing member while the aforesaid developing bias source applied the alternating voltage to the gap 'd' to effect the development process, the alternating voltage formed by superimposing the DC voltage of −350 V and the AC voltage having the peak-to-peak value Vpp of 1600 V, the frequency of 2000 Hz and the duty ratio of 30%. In this case, a back-transfer electric field acting to bias the toner on the imaged area of the image bearing member back to the toner bearing member had a magnitude of $2.2\times10^{-6}$ V/m and a per-period effective time of $3.50\times10^{-4}$ sec., as shown in Table 2. That is, the magnitude of the back-transfer electric field was decreased from $2.5\times10^{-6}$ V/m.

In the developing device of Example 6, the gap 'd' of 120 μm was formed between the image bearing member and the toner bearing member while the aforesaid developing bias source applied an alternating voltage to the gap 'd' to effect the development process, the alternating voltage formed by superimposing the DC voltage of −350 V and an AC voltage having a peak-to-peak value Vpp of 1600 V, a frequency of 3000 Hz and a duty ratio of 20%. In this case, a back-transfer electric field acting to bias the toner on the imaged area of the image bearing member back to the toner bearing member had a magnitude of $4.6\times10^{-6}$ V/m and a per-period effective time of $2.67\times10^{-4}$ sec., as shown in Table 2. That is, the effective time of the back-transfer electric field was decreased from $3.0\times10^{-4}$ sec.

TABLE 2

| | TYPE OF TONER | TONER | | BACK-TRANSFER ELECTRIC FIELD | |
|---|---|---|---|---|---|
| | BEARING MEMBER | TYPE | PARTICLE SIZE (μm) | MAGNITUDE OF FIELD (V/M) | EFFECTIVE TIME (SEC) |
| EXAMPLE 1 | A1 | T1 | 6.5 | $4.6\times10^{-6}$ | $3.50\times10^{-4}$ |
| EXAMPLE 2 | A2 | T1 | 6.5 | $4.6\times10^{-6}$ | $3.50\times10^{-4}$ |
| EXAMPLE 3 | A3 | T3 | 5.2 | $4.6\times10^{-6}$ | $3.50\times10^{-4}$ |
| EXAMPLE 4 | A6 | T1 | 6.5 | $4.6\times10^{-6}$ | $3.50\times10^{-4}$ |
| EXAMPLE 5 | A1 | T1 | 6.5 | $2.2\times10^{-6}$ | $3.50\times10^{-4}$ |
| EXAMPLE 6 | A1 | T1 | 6.5 | $4.6\times10^{-6}$ | $2.67\times10^{-4}$ |
| COMPARATIVE EXAMPLE 1 | A4 | T1 | 6.5 | $4.6\times10^{-6}$ | $3.50\times10^{-4}$ |
| COMPARATIVE EXAMPLE 2 | A5 | T3 | 5.2 | $4.6\times10^{-6}$ | $3.50\times10^{-4}$ |

TABLE 2-continued

| | TYPE OF TONER | TONER | | BACK-TRANSFER ELECTRIC FIELD | |
|---|---|---|---|---|---|
| | BEARING MEMBER | TYPE | PARTICLE SIZE ($\mu$m) | MAGNITUDE OF FIELD (V/M) | EFFECTIVE TIME (SEC) |
| COHPARATIVE EXAMPLE 3 | A7 | T1 | 6.5 | $4.6 \times 10^{-6}$ | $3.50 \times 10^{-4}$ |
| COMPARATIVE EXAMPLE 4 | A8 | T1 | 6.5 | $4.6 \times 10^{-6}$ | $3.50 \times 10^{-4}$ |
| COMPARATIVE EXAMPLE 5 | A9 | T1 | 6.5 | $4.6 \times 10^{-6}$ | $3.50 \times 10^{-4}$ |
| COMPARATIVE EXAMPLE 6 | A1 | T2 | 9.2 | $4.6 \times 10^{-6}$ | $3.50 \times 10^{-4}$ |

TABLE 3

| | TONER | | | | | | |
|---|---|---|---|---|---|---|---|
| | CONVEYANCE AMOUNT (g/m$^2$) | ELECTRO-STATIC CHARGE ($\mu$C/g) | DENSITY VARIATIONS | HALF-TONE VARIATIONS | FOGGING | DOT RE-PRODUCIBILITY | STREAKING |
| EXAMPLE 1 | 6.7 | −32.4 | ○ | ○ | ○ | ○ | ○ |
| EXAMPLE 2 | 6.2 | −35.7 | ○ | ○ | ○ | ○ | ○ |
| EXAMPLE 3 | 7.6 | −29.1 | ○ | ○ | ○ | ○ | ○ |
| EXAMPLE 4 | 6.6 | −31.9 | Δ | Δ | ○ | ○ | ○ |
| EXAMPLE 5 | 6.8 | −32.6 | ○ | ○ | ○ | ○ | Δ |
| EXAMPLE 6 | 6.6 | −32.1 | ○ | ○ | Δ | ○ | Δ |
| COMPARATIVE EXAMPLE 1 | 5.6 | −38.2 | X | X | Δ | Δ | Δ |
| COMPARATIVE EXAMPLE 2 | 8.1 | −26.8 | ○ | ○ | X | Δ | ○ |
| COMPARATIVE EXAMPLE 3 | 6.5 | −31.8 | X | X | Δ | ○ | ○ |
| COMPARATIVE EXAMPLE 4 | 6.8 | −32.0 | X | X | Δ | ○ | ○ |
| COMPARATIVE EXAMPLE 5 | 6.9 | −30.5 | ○ | ○ | X | Δ | Δ |
| COMPARATIVE EXAMPLE 6 | 7.8 | −28.1 | ○ | ○ | ○ | X | ○ |

According to the results, the developing devices of Examples 1 to 6 achieved higher evaluations than those of Comparative Examples 1 to 6 with respect to the density variations, half-tone variations, fogging, dot reproducibility and streaking. Examples 1 to 6 each employed any one of the toner bearing members A1 to A3 and A6 satisfying the condition $\rho 2 \leqq \rho 1 \leqq \rho 3$ where $\rho 1$ denotes the volume resistance of the elastic layer, $\rho 2$ denoting the volume resistance of the intermediate layer, and $\rho 3$ denoting the volume resistance of the surface layer, and having the arithmetic average surface roughness Ra in the range of 0.8 to 2.5 $\mu$m, as well as either of the toners T1 and T3 having the volume-average particle size in the range of 3 to 8 $\mu$m.

On the other hand, the developing device of Example 4 had somewhat lower evaluations for the density variations and half-tone variations, because of the use of the toner bearing member A5 including the elastic layer having the volume resistance $\rho$ of $6.7 \times 10^6$ $\Omega \cdot$m which was out of the specified range $1 \times 10^4$ $\Omega \cdot \text{m} \leqq \rho 1 \leqq 1 \times 10^6$ $\Omega \cdot$m.

In addition, the developing devices of Examples 5 and 6 had somewhat lower evaluations for the streaking because the development process did not follow the conditions set forth in claim 3 that in the alternating electric field applied between the image bearing member and the toner bearing member for development, the back-transfer electric field acting to bias the toner on the imaged area of the image bearing member back to the toner bearing member have the magnitude in the range of $2.5 \times 10^{-6}$ to $14 \times 10^{-6}$ V/m and the per-period effective time of at least $3.0 \times 10^{-4}$ sec.

As specifically described above, in the developing device according to the first embodiment, in the case where the employed toner bearing member 21 satisfy $\rho 2 \leqq \rho 1 \leqq \rho 3$, where $\rho 1$, $\rho 2$ and $\rho 3$ denote the volume resistances of the elastic layer 21*b*, intermediate layer 21*c* and surface layer 21*d*, respectively, the intermediate layer 21*c* having the smaller volume resistance $\rho 2$ alleviates the variations of the volume resistance $\rho 1$ of the elastic layer 21*b* while the surface layer 21*d* having the greater volume resistance $\rho 3$ contributes to a suitable volume resistance of the toner bearing member 21 as a whole. This is effective to suppress the variations of the alternating electric field applied between the toner bearing member 21 and the image bearing member 10. Accordingly, favorable images less susceptible to density variations may be formed even when a toner 't' of fine particles having a volume-average particle size of 3 to 8 $\mu$m is used.

In the case of the toner bearing member 21 having the arithmetic average surface roughness Ra of 0.8 to 2.5 $\mu$m which is used in combination with the toner 't' of fine particles having the volume-average particle size of 3 to 8 $\mu$m, the toner bearing member 21 is less prone to cause fogging on the resultant image by delivering an excessive amount of toner 't' to the development region, or to cause density variations of the resultant image by delivering an insufficient amount of toner 't' to the development region. Hence, favorable images may be obtained.

Second Embodiment

Figure 3:
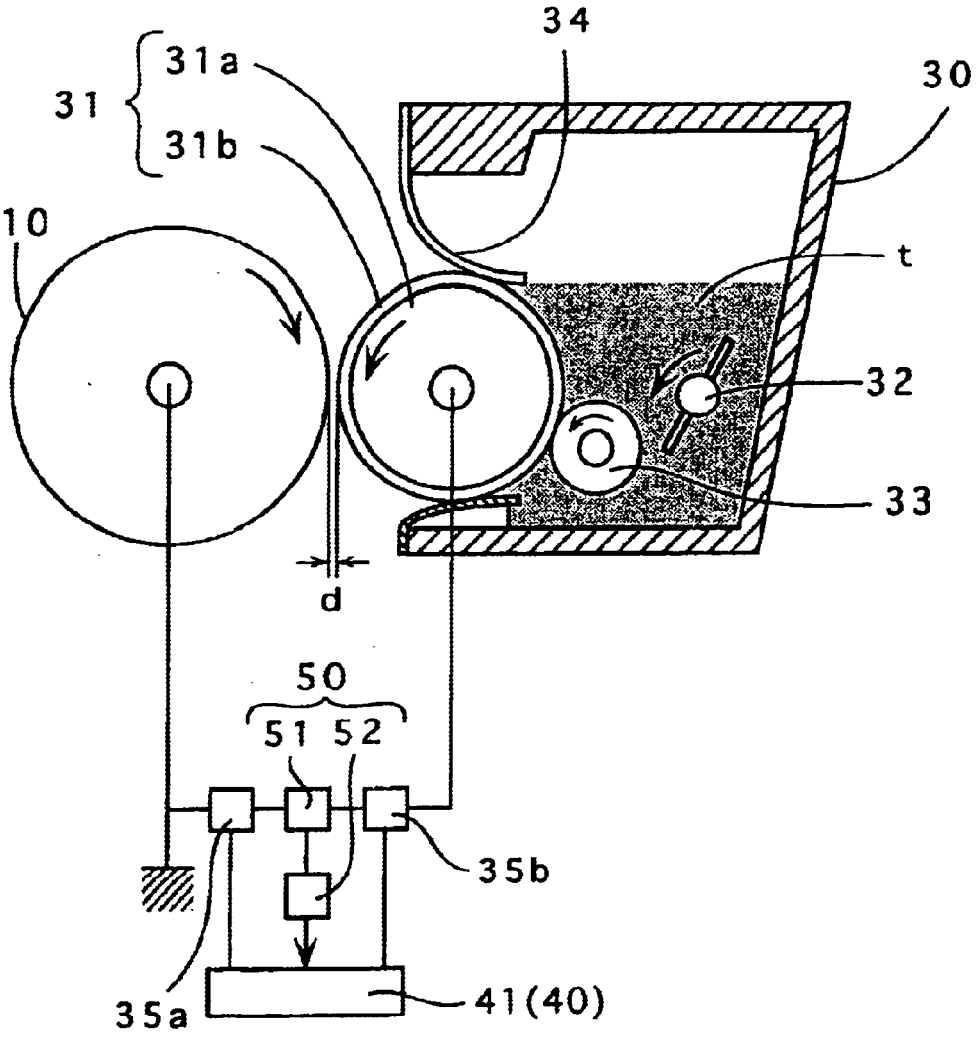
FIG. 3 is a schematic diagram showing a developing device according to a second embodiment of the invention.

As shown in FIG. 3, a developing device according to a second embodiment is arranged as follows. A toner bearing member 31 comprises a conductive substrate 31*a* of a metal roller aid a resistance layer 31*b* formed on an outer periphery of the conductive substrate. The toner bearing member 31 is disposed in a manner to oppose the image bearing member 10 via the predetermined gap 'd' in the development region. The toner bearing member 31 and the image bearing member 10 are rotated while the toner 't' stored in a main body 30 of the developing device is moved by a feed member 32 toward a feed roller 33 in rotating contact with the toner bearing member 31. The feed roller 33 feeds the toner 't' onto the surface of the toner bearing member 31.

A regulating member 34 regulates the amount of toner 't' held on the surface of the toner bearing member 31 while triboelectrifying the toner 't'. Subsequently, the toner 't' is introduced into the development region by means of the toner bearing member 31. At the same time, a developing bias voltage formed by superimposing a DC voltage from a DC source 35*a* and an AC voltage from an AC source 35*b* is applied between the toner bearing member 31 and the image bearing member 10, such that the toner 't' is supplied to an electrostatic latent image formed on the image bearing member 10 to develop the latent image.

Prior to the development process, the developing device of the second embodiment uses the following means to properly set the developing bias voltage applied by the DC source 35*a* and AC source 35*b*. That is, the developing device is provided with a voltage regulator 41 for varying the voltages applied, by the DC source 35*a* and AC source 35B, between the toner bearing member 31 and the image bearing member 10, the voltage regulator 41 serving as a leakage generator 40 for producing leakage between these members 10 and 31.

In addition, the developing device is further provided with a leakage detector unit 50 for detecting leakage based on current flowing between the image bearing member 10 and the toner bearing member 31. The leakage detector unit 50 includes a current sensor 51 for sensing the current flowing between the image bearing member 10 and the toner bearing member 31, and a controller 52 which determines the presence of leakage based on an output given by the current sensor 51 and controls the voltage regulator 41.

The controller 52 controls the voltage regulator 41 as follows until the leakage is detected. Under control, the voltage regulator 41 varies a leakage detection voltage applied between the toner bearing member 31 and the image bearing member 10 so as to produce the leakage between these members 31 and 10.

Based on a leakage detection voltage at the occurrence of the leakage, the controller 52 provides control of the voltage regulator 41 such that the DC source 35*a* and AC source 35*b* may apply such a developing bias voltage between the toner bearing member 31 and the image bearing member 10 as to effect the development process under proper conditions involving no leakage.

For the detection of the leakage between the image bearing member 10 and the toner bearing member 31 the leakage detection voltage applied between these members 31 and 10 may be formed by superimposing the DC voltage and the AC voltage or may be composed of the DC voltage alone.

Figure 4:
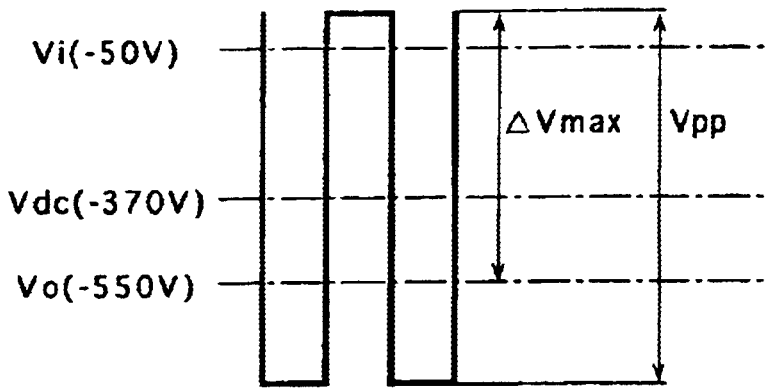
FIG. 4 is a diagram showing a wave form of a first leakage detection voltage applied between a toner bearing member and an image bearing member of the developing device of the second embodiment for detection of leakage between the toner bearing member and the image bearing member.

In a developing device using a negatively chargeable toner 't' for reversal development, the leakage between the toner bearing member 31 and the image bearing member 10 is detected by applying the leakage detection voltage formed by superimposing the DC voltage and the AC voltage. However, a problem exists when, for example, the leakage to be detected is produced in the following manner. As shown in FIG. 4, a surface potential Vo of the image bearing member 10 is maintained at −550 V. In this state, the DC source 35*a* applies a DC voltage Vdc of −370 V while a peak-to-peak value Vpp of the AC voltage from the AC source 35*b* is varied whereby a maximum potential difference ΔVmax between the leakage detection voltage and the surface potential Vo of the image bearing member 10 is increased to produce the leakage between the toner bearing member 31 and the image bearing member 10. When, in this case, a surface potential Vi at a leaked portion of the image bearing member 10 reaches −50 V, the toner 't' is supplied to this leaked portion and wasted.

Figure 5:
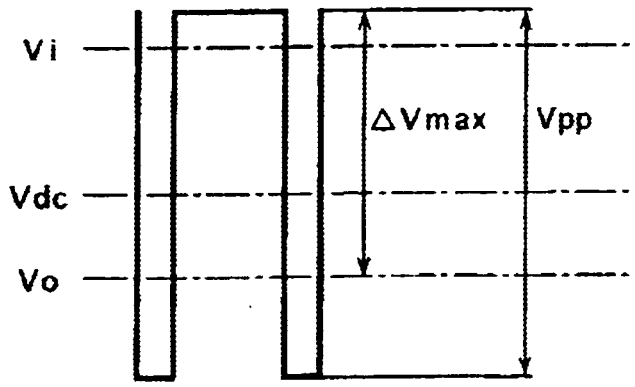
FIG. 5 is a diagram showing a wave form of a second leakage detection voltage applied between the toner bearing member and the image bearing member of the developing device of the second embodiment for detection of the leakage between the toner bearing member and image bearing member.
Figure 6:
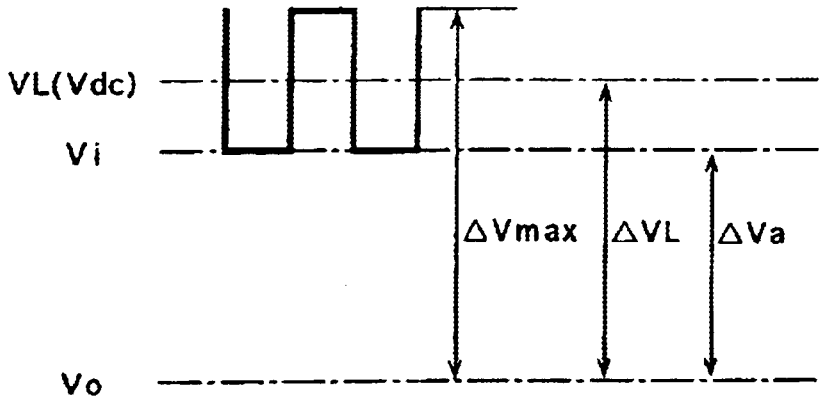
FIG. 6 is a diagram showing a wave form of a third leakage detection voltage applied between the toner bearing member and the image bearing member of the developing device of the second embodiment for detection of the leakage between the toner bearing member and image bearing member.

Therefore, the following approaches may preferably be taken when the leakage between the toner bearing member 31 and the image bearing member 10 is detected by applying the leakage detection voltage formed by superimposing the DC voltage and the AC voltage. That is, as shown in FIG. 5, an AC voltage having a shorter duration of a voltage of a developing direction (a smaller duty ratio) may be applied. Otherwise, as shown in FIG. 6, an arrangement may be made to satisfy a condition $\Delta VL \geqq \Delta Va$ where $\Delta VL$ ($=|Vo-VL|$) denotes a potential difference between an average voltage VL of the leakage detection voltage formed by superimposing the DC and AC voltages (the average voltage is equal to a DC voltage Vdc from the DC source 35*a* when an AC voltage has a duty ratio of 50%) and a surface potential Vo at an unleaked portion of the image bearing member 10 whereas $\Delta Va$ ($=|Vo-Vi|$) denotes a potential difference between the surface potential Vo at the unleaked portion of the image bearing member 10 and the surface potential Vi at the leaked portion of the image bearing member 10.

Figure 7:
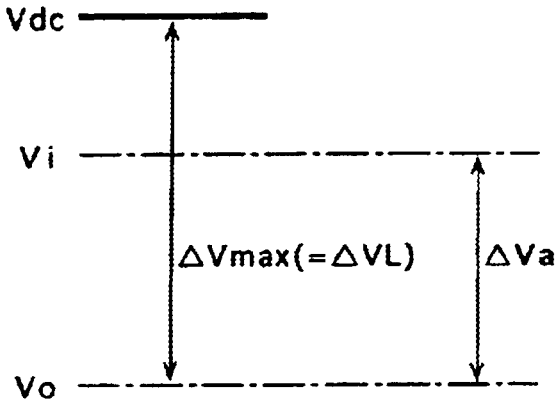
FIG. 7 is a diagram showing a wave form of a fourth leakage detection voltage applied between the toner bearing member and the image bearing member of the developing device of the second embodiment for detection of the leakage between the toner bearing member and image bearing member.

In a case where the DC voltage Vdc alone is applied as the leakage detection voltage, as shown in FIG. 7, the toner 't' is not supplied to the leaked portion of the image bearing member 10.

Figure 8:
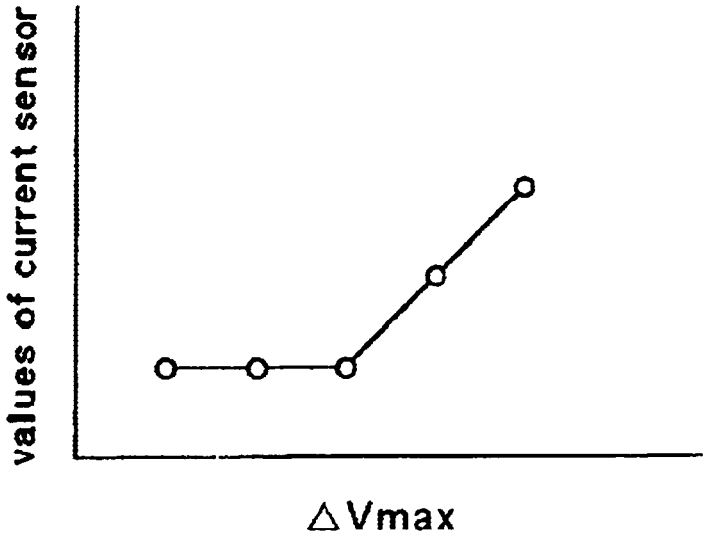
FIG. 8 is a graphical representation of successively increased values of a current sensor in association with increased maximum potential differences $\Delta V_{max}$ when the leakage is produced in the developing device of the second embodiment by progressively increasing the maximum potential difference $\Delta V_{max}$ between the leakage detection voltage applied between the image bearing member and toner bearing member, and a surface potential of the image bearing member.

According to the leakage detector unit 50 for detecting the leakage based on the current flowing between the image bearing member 10 and the toner bearing member 31, there may be a case where the controller 52 responds to the current sensor 51 erroneously sensing noises in another circuit than the leakage as the leakage current and determines such noises as the leakage. Therefore, the following arrangement as shown in FIG. 8 may preferably be made. That is the voltage regulator 41 is adapted to progressively increase the maximum potential difference ΔVmax between the leakage detection voltage applied between the image bearing member 10 and the toner bearing member 31 and the surface potential Vo of the image bearing member 10. On the other hand, the controller 52 is designed to determine the occurrence of leakage based on successively increased values given by the current sensor 51 sensing the current flowing between the image bearing member 10 and the toner bearing member 31.

Figure 9:
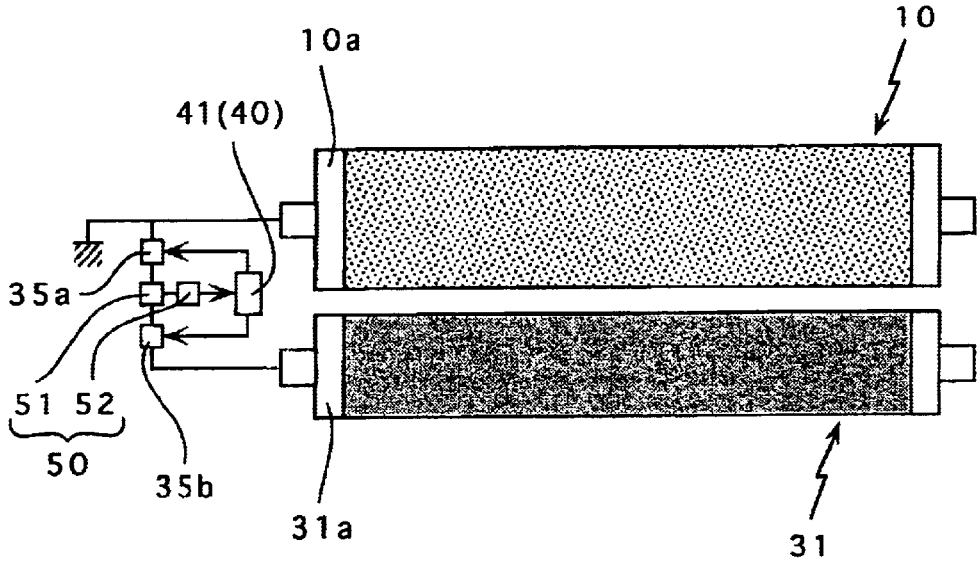
FIG. 9 is a schematic diagram showing a state of the developing device of the second embodiment wherein the image bearing member and the toner bearing member have a respective metal portion thereof exposed at a respective end thereof and the leakage is produced between the metal portions of the image bearing member and toner bearing member.

The current sensor 51 for sensing the amount of current between the image bearing member 10 and the toner bearing member 31 encounters a problem associated with minor variations of the current between these members 10 and 31. However, the following approach as shown in FIG. 9 may be taken to increase the variations of the current between these members 10 and 31. That is, the image bearing member 10 and the toner bearing member 31 have a respective metal portion 10*a*, 31*a* at a respective end thereof exposed so that the leakage may be produced between these exposed metal portions 10*a*, 31*a* for increasing the variations of the current between these members 10 and 31. In this case, leakages between the metal portions 10*a*, 31*a* and between the other portions than the metal portions 10*a*, 31*a* are produced by different voltages. This dictates a need for previously determining a correlation between the voltage causing the leakage between the metal portions 10*a*, 31*a* and the voltage causing the leakage between the other portions than the metal portions 10*a*, 31*a*. Based on the correlation, the controller 52 may control the voltage regulator 41 which, in turn, may regulate the developing bias voltage to be applied between the toner bearing member 31 and the image bearing member 10.

In the developing device according to the second embodiment, an operation is performed for setting the developing bias voltage to a proper value based on the leakage produced between the image bearing member 10 and the toner bearing member 31, the developing bias voltage applied by the DC voltage source 35*a* and the AC voltage source 35*b*. It is preferred that such an operation is performed not only when a new developing device is started to operate but also when this developing device has been operated to produce a predetermined number of copies. This ensures that a proper developing bias voltage is applied between the image bearing member 10 and the toner bearing member 31 at all times.

Unlike the conventional devices, the developing device of the second embodiment negates the need for the expensive density sensor because the leakage generator 40 varies the leakage detection voltage applied between the image bearing member 10 and the toner bearing member 31 to produce the leakage between these members 10 and 31, while the leakage detector unit 50 determines the amount of current caused by the leakage to flow between these members 10 and 31. Thus, the developing device of the embodiment not only achieves the cost reduction but also ensures the detection of leakage wherever it may occur.

Accordingly, even in the case of an error of the gap between the toner bearing member 31 and the image bearing member 10, the invention provides proper control of the developing bias voltage while preventing the leakage between the toner bearing member 31 and the image bearing member 10. As a result, the stable formation of favorable images free from noises is ensured.

Although the present invention has been fully described by way of examples, it is to be noted that various changes and modifications will be apparent to those skilled in the art. Therefore, unless otherwise such changes and modifications depart from the scope of the present invention, they should be construed as being included therein.

What is claimed is:

1. A mono-component developing device for developing an electrostatic latent image formed on an image bearing member comprising:

a toner bearing member holding a toner on its surface for conveyance of the toner to a development region where the toner bearing member opposes the image bearing member via a predetermined gap therebetween a regulating member pressed against the surface of the toner bearing member for regulation of the amount of toner conveyed to the development region; and a developing bias source for applying an alternating electric field between the toner bearing member and the image bearing member, wherein the toner bearing member includes a conductive substrate formed with an elastic layer, an intermediate layer and a surface layer on the surface thereof, respective volume resistances $\rho 1$, $\rho 2$ and $\rho 3$ of which layers satisfy a condition $\rho 2 \leqq \rho 1 \leqq \rho 3$, the toner bearing member having an arithmetic average surface roughness in the range of 0.8 to 2.5 $\mu$m, and wherein the toner has a volume-average particle size in the range of 3 to 8 $\mu$m.

2. The developing device as claimed in claim 1, wherein the volume resistance $\rho 1$ of the elastic layer is in the range of $1\times10^4$ to $1\times10^6$ $\Omega\cdot$m, the volume resistance $\rho 2$ of the intermediate layer is not more than $1\times10^4$ $\Omega\cdot$m, and the volume resistance $\rho 3$ of the surface layer is in the range of $1\times10^6$ to $1\times10^{12}$ $\Omega\cdot$m.

3. The developing device as claimed in claim 1, wherein when the developing bias source applies the alternating electric field between the toner bearing member and the image bearing member, a back-transfer electric field acting to bias the toner on an imaged area of the image bearing member back to the toner bearing member has a magnitude in the range of $2.5\times10^{-6}$ to $14\times10^{-6}$ V/m and a per-period effective time of at least $3.0\times10^{-4}$ sec.

4. A mono-component developing device for developing an electrostatic latent image formed on an image bearing member comprising:

a toner bearing member holding a toner on its surface for conveyance of the toner to a development region where the toner bearing member opposes the image bearing member via a predetermined gap therebetween;

a regulating member pressed against the surface of the toner bearing member for regulation of the amount of toner conveyed to the development region;

a developing bias source for applying an alternating electric field between the toner bearing member and the image bearing member;

a leakage generator varying a leakage detection voltage applied between the image bearing member and the toner bearing member for production of leakage between the image bearing member and the toner bearing member; and a leakage detector unit for detecting the leakage based on current flowing between the image bearing member and the toner bearing member.

5. The developing device as claimed in claim 4, wherein the leakage detector unit determines the occurrence of leakage based on successively increased values of the current flowing between the image bearing member and the toner bearing member when a maximum potential difference $\Delta V_{max}$ between the leakage detection voltage and a surface potential of the image bearing member is progressively increased.

6. The developing device as claimed in claim 4, wherein a potential difference $\Delta VL$ between an average of the leakage detection voltage and a surface potential of the image bearing member, and a potential difference $\Delta Va$ between a pre-leakage surface potential of the image bearing member and a post-leakage surface potential of the image bearing member satisfy a condition $\Delta VL \geqq \Delta Va$.

* * * * *